US006683573B2

(12) United States Patent
Park

(10) Patent No.: US 6,683,573 B2
(45) Date of Patent: Jan. 27, 2004

(54) MULTI BAND CHIP ANTENNA WITH DUAL FEEDING PORTS, AND MOBILE COMMUNICATION APPARATUS USING THE SAME

(75) Inventor: Heung Soo Park, Suwon (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 0 days.

(21) Appl. No.: 10/230,137

(22) Filed: Aug. 29, 2002

(65) Prior Publication Data

US 2003/0193439 A1 Oct. 16, 2003

(30) Foreign Application Priority Data

Apr. 16, 2002 (KR) ..... 2002-20650

(51) Int. Cl.[7] ..... H01Q 1/36
(52) U.S. Cl. ..... 343/700 MS; 343/702
(58) Field of Search ..... 343/700 MS, 702, 343/846, 848

(56) References Cited

U.S. PATENT DOCUMENTS 5,861,854 A * 1/1999 Kawahata et al. ..... 343/702
6,323,811 B1 * 11/2001 Tsubaki et al. ..... 343/700 MS
6,600,449 B2 * 7/2003 Onaka et al. ..... 343/700 MS
6,614,398 B2 * 9/2003 Kushihi et al. ..... 343/700 MS
2003/0122722 A1 * 7/2003 Sugiyama et al. ..... 343/767

OTHER PUBLICATIONS

Patent Abstract of Japan Publication No. 11–239018 Filed Aug. 31, 1999.

* cited by examiner

*Primary Examiner*—Tan Ho
(74) *Attorney, Agent, or Firm*—Lowe Hauptman Gilman & Berner LLP

(57) ABSTRACT

Disclosed is a multi band chip antenna with dual feeding ports formed on a radiation electrode structure, thereby performing the electromagnetic coupling between the dual feeding ports and being usable at multiple frequency bands. Further, a mobile communication apparatus using the multi band chip antenna is disclosed. The multi band chip antenna comprises a first conductive feeding port, a second conductive feeding port, a conductive power-feeding electrode connected to the first feeding port, a conductive loop-type electrode connected to the second feeding port, a conductive radiation electrode electrically connected to the power-feeding electrode, a conductive ground electrode connected to the radiation electrode, and a conductive ground electrode port connected to the ground electrode and the loop-type electrode. The multi band chip antenna of the present invention is miniaturized, and the mobile communication apparatus using the multi band chip antenna does not require a diplexer.

24 Claims, 7 Drawing Sheets

(a)

(a)

(b)

(a)

(b)

(a)

(b)

MULTI BAND CHIP ANTENNA WITH DUAL FEEDING PORTS, AND MOBILE COMMUNICATION APPARATUS USING THE SAME

BACKGROUND OF THE INVENTION

1. Field of the Invention

The present invention relates to a multi band chip antenna with dual feeding ports and a mobile communication apparatus using the multi band chip antenna, and more particularly to a multi band chip antenna, in which dual feeding ports are formed on a radiation electrode structure, thereby being usable at multi frequency bands, and a mobile communication apparatus using the multi band chip antenna.

2. Description of the Related Art

Recently, development trends of mobile communication terminals have been directed toward miniaturization, lightweight, and multi-functionality. In order to satisfy this trend, circuits and parts of the mobile communication terminals have been miniaturized and made multi-functional. Therefore, antennas of the mobile communication terminals have also been miniaturized and-made multi-functional.

Generally, antennas which are used in the mobile communication terminals are divided into two types, i.e., a helical antenna and a planar inverted F-type antenna (referred to as a "PIFA"). The helical antenna is an external antenna, which is fixed to the upper surface of the terminal. The helical antenna is mostly used in combination with a monopole antenna. This combined structure of the helical antenna and the monopole antenna has a length of $\lambda/4$. Herein, the monopole antenna is an internal antenna, which is stored within the terminal. The monopole antenna is pulled out, thereby being used as the antenna of the terminal in combination with the external, helical antenna.

The combined structure of the helical antenna and the monopole has high gain. However, this combined structure of the helical antenna and the monopole antenna has a low SAR(Specific Absorption Rate) characteristic due to the non-directivity. Herein, the SAR characteristic is an index of harmfulness of an electromagnetic wave to the human body. It is difficult to aesthetically and portably design the appearance of the helical antenna. Further, the monopole antenna requires a storage space within the terminal. Therefore, the combined structure of the helical antenna and the monopole antenna limits the miniaturization of the mobile communication product using this structure. In order to solve these problems, a chip antenna having a low profile structure has been introduced.

FIG. 1 is a schematic view illustrating a principle of operation of a conventional chip antenna. The chip antenna of FIG. 1 is referred to as the planar inverted F-type antenna (PIFA). The name of the chip antenna is due to its shape. As shown in FIG. 1, the chip antenna comprises a radiation patch (RE), a short-circuit pin (GT), a coaxial line (CL), and a ground plate (GND). Herein, power is supplied to the radiation patch (RE) through the coaxial line (CL). The radiation patch (RE) is connected to the ground plate (GND) through the short-circuit pin (GT), thereby performing the impedance matching. It is to be noted that the chip antenna is designed so that the length (L) of the radiation patch (RE) and the height (H) of the antenna are determined by the width (Wp) of the short-circuit pin (GT) and the width (W) of the radiation patch (RE).

In this chip antenna, among beams generated by the induced current to the radiation patch (RE), beams directed toward the ground plane are re-induced, thereby reducing the beams directed toward the human body and improving the SAR characteristic. Further, the beams induced toward the radiation patch (RE) are improved. And, the chip antenna has a lower profile structure, thereby being currently spotlighted. Further, in order to satisfy the trend of multi-functionality, the chip antenna has been variously modified, thereby being particularly developed as a dual band chip antenna, which is usable at multiple frequency bands.

FIG. 2*a* is a perspective view of a conventional dual band chip antenna, and FIG. 2*b* is a schematic view of a configuration of a mobile communication apparatus using the conventional dual band chip antenna.

With reference to FIG. 2*a*, the conventional dual band chip antenna 10 comprises a radiation patch 12 formed in a planar square shape, a short-circuit pin 14 for grounding the radiation patch 12, a power-feeding pin 15 for feeding power to the radiation patch 12, and a dielectric block 11 provided with a ground plate 19. In order to achieve dual band function, an U-type slot may be formed on the radiation patch 12. Herein, the radiation patch 12 is substantially divided into two areas by the slot, thereby inducing the current flowing along the slot to have different lengths so as to resonate in two different frequency bands. Therefore, the dual band chip antenna 10 is operated in two different frequency bands, for example, GSM band and DCS band.

However, recently, the usable frequency band has been variously diversified, i.e., CDMA (Code Division Multiple Access) band (approximately 824~894 MHz), GPS (Global Positioning System) band (approximately 1,570~1,580 MHz), PCS (Personal Communication System) band (approximately 1,750~1,870 MHZ or 1,850~1,990 MHZ), and BT (Blue Tooth) band (approximately 2,400~2,480 MHz), thereby requiring a multiple band characteristic more than the dual band characteristic. Therefore, the system using the aforementioned slot is limited in designing the antenna with the multiple band characteristic. Further, since the conventional antenna has a low profile so as to be mounted on the mobile communication terminal, the usable frequency band is narrow. Particularly, the height of the antenna is restricted by the limited width of the terminal of the mobile communication apparatus, thereby further increasing the problem of the narrow frequency band.

The dual band chip antenna of FIG. 2*a* comprises one feeding port connected to the power-feeding pin 15. In case that this dual band chip antenna is installed on a mobile communication apparatus, such as a dual band phone, as shown in FIG. 2*b*, the mobile communication apparatus requires a band splitting unit 21 for splitting the frequency band from the chip antenna 10 into GPS band and CDMA band. For example, the band splitting unit 21 is a diplexer or a switch. Therefore, it is difficult to miniaturize the mobile communication apparatus using the dual band chip antenna. Further, the band splitting unit incurs a loss to the gain.

In order to solve the problem of the narrow frequency bandwidth, a distribution circuit such as a chip-type LC device is additionally connected to the antenna, thereby controlling the impedance matching and achieving a somewhat wide frequency band. However, this method, in which the external circuit is involved in the frequency modulation, causes another problem, i.e., the deterioration of the antenna efficiency.

FIG. 3 is a perspective view of another conventional chip antenna. With reference to FIG. 3, the chip antenna 10 comprises a body 2 having a hexahedral shape, which is made of dielectric material or magnetic material, a ground electrode 3 formed on one whole surface of the body 2, a radiation electrode 4 formed on at least another whole surface of the body 2, and a power-feeding electrode 5 formed on yet another surface of the body 2. One end 4*a* of the radiation electrode 4 is opened and is formed adjacent to the power-feeding electrode 5. The one end 4*a* of the radiation electrode 4 is spaced from the power-feeding electrode 5 by a gap 6. The other end of the radiation electrode 4 is branched into multiple sections, thereby forming ground terminals 4*b* and 4*c*. The ground terminals 4*b* and 4*c* are connected to the ground electrode 3 via different surfaces of the body 2. Japanese Laid-open Publication No. Heisei 11-239018 discloses the configuration of this chip antenna in detail.

In accordance with this chip antenna, the radiation electrode is divided into two sections. The divided two sections are grounded by two ground terminals 4*b* and 4*c*. Therefore, the current flows along each one of the ground terminals 4*b* and 4*c* is reduced by half, thereby reducing the conduction loss on each of the ground terminals 4*b* and 4*c*, and improving the gain of the antenna without changing the size of the antenna.

However, the chip antenna of FIG. 3 cannot be used at multiple bands more than two bands. Further, since the chip antenna of FIG. 3 comprises one feeding port, in case that this chip antenna is installed on the mobile communication apparatus as shown in FIG. 2*b*, the mobile communication apparatus requires the band splitting unit 21 for splitting the frequency band from the chip antenna into GPS band and CDMA band. For example, the band splitting unit 21 is the diplexer or the switch. Therefore, the chip antenna of FIG. 3 has the same problems as the chip antenna of FIG. 2*a*.

Accordingly, a chip antenna, which has a low profile structure, is usable at multiple frequency bands, and minimizes the size of the mobile communication apparatus installed with the chip-antenna, has been demanded.

SUMMARY OF THE INVENTION

Therefore, the present invention has been made in view of the above problems, and it is an object of the present invention to provide a multi band chip antenna comprising dual feeding ports formed on a radiation electrode, which is usable in multiple frequency bands, thereby reducing loss in splitting the frequency band, minimizing its size, and not requiring any band splitting unit such as a diplexer, and a mobile communication apparatus using the multi band chip antenna.

In accordance with the present invention, the above and other objects can be accomplished by the provision of a chip antenna comprising a first conductive feeding port, a second conductive feeding port, a conductive power-feeding electrode connected to the first feeding port, a conductive loop-type electrode connected to the second feeding port, a conductive radiation electrode connected to the power-feeding electrode, a conductive ground electrode connected to the radiation electrode, and a conductive ground electrode port connected to the ground electrode and the loop-type electrode.

Preferably, the first feeding port may perform the electromagnetic coupling with the second feeding port. Further, the second feeding port may be connected to one end of the loop-type electrode, and the ground electrode port may be connected to the other end of the loop-type electrode. Herein, the loop-type electrode is formed in a loop shape with a designated length from one end connected to the second feeding port to the other end connected to the ground electrode port

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
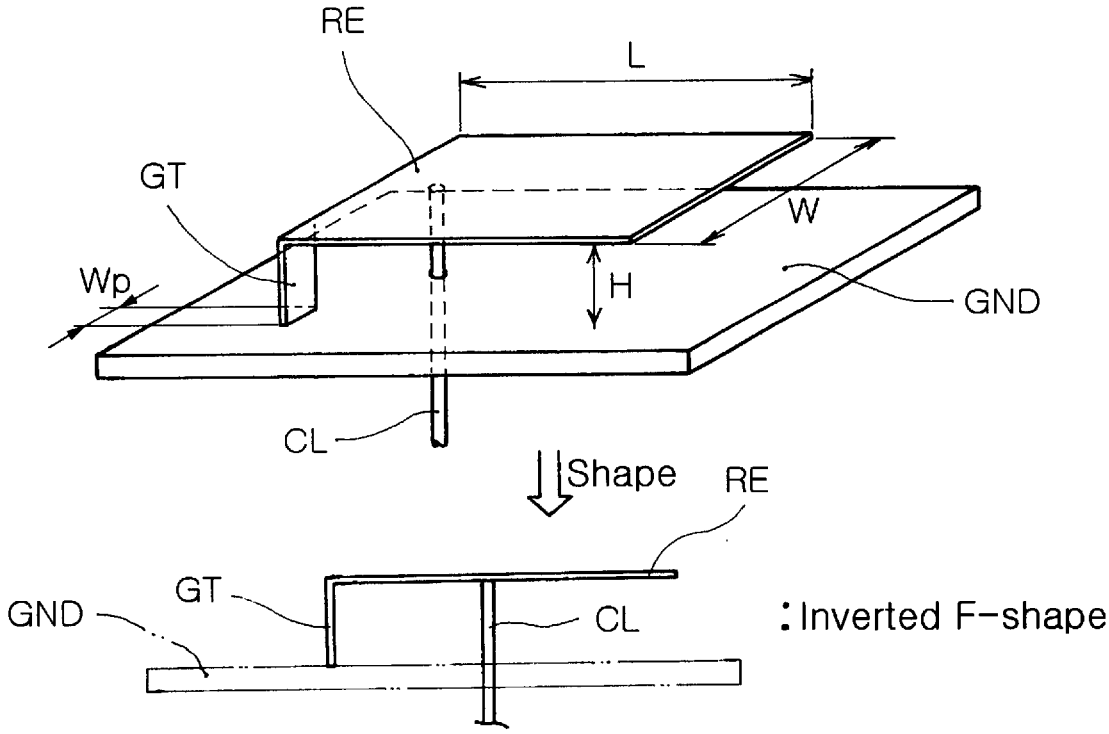
PRIOR ART FIG. 1
FIG. 1 is a schematic view illustrating a principle of operation of a conventional chip antenna.
Figure 2:
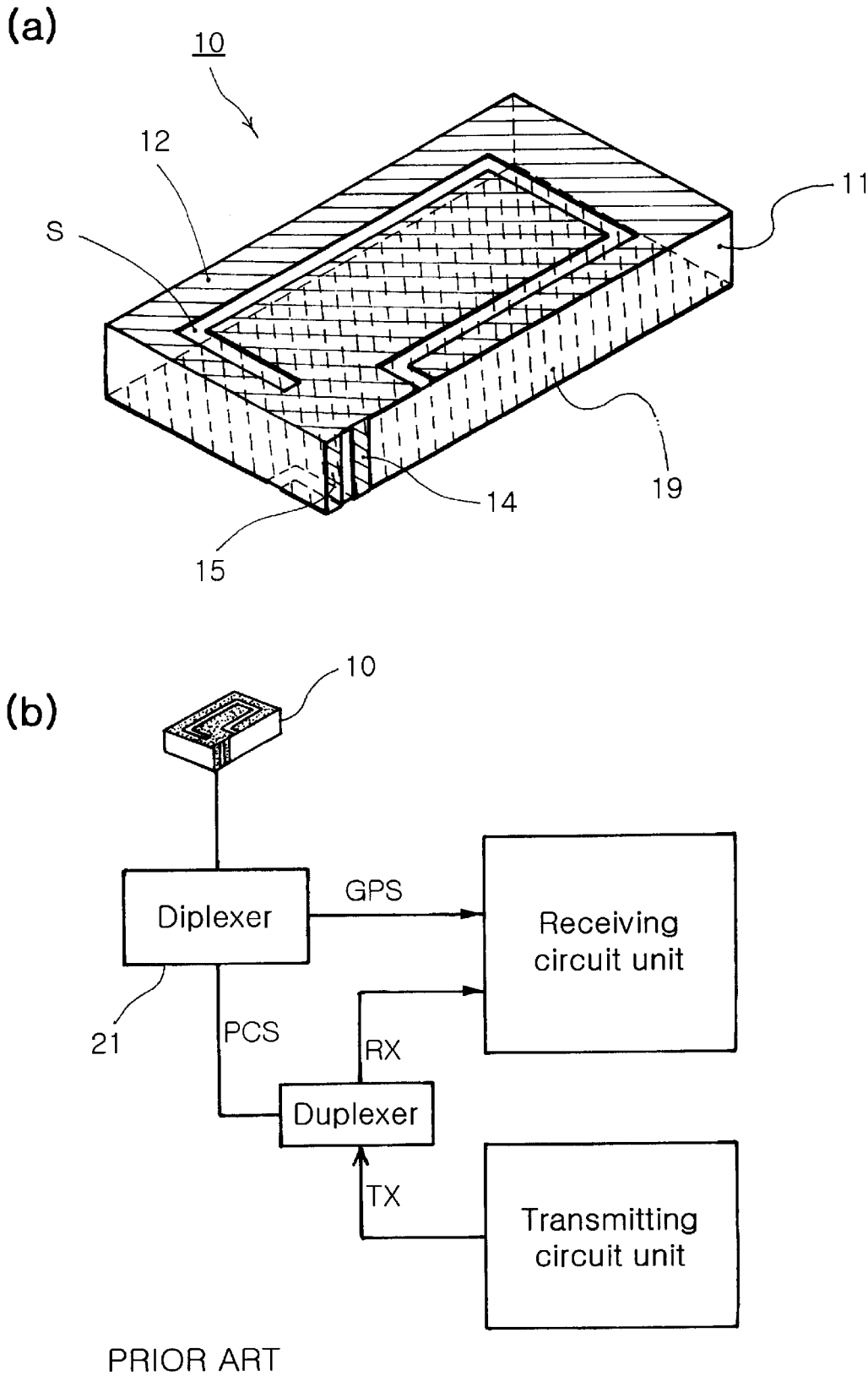
PRIOR ART FIG. 2
FIG. 2*a* is a perspective view of a conventional chip antenna.
FIG. 2*b* is a schematic view of a configuration of a mobile communication apparatus using the conventional chip antenna.
Figure 3:
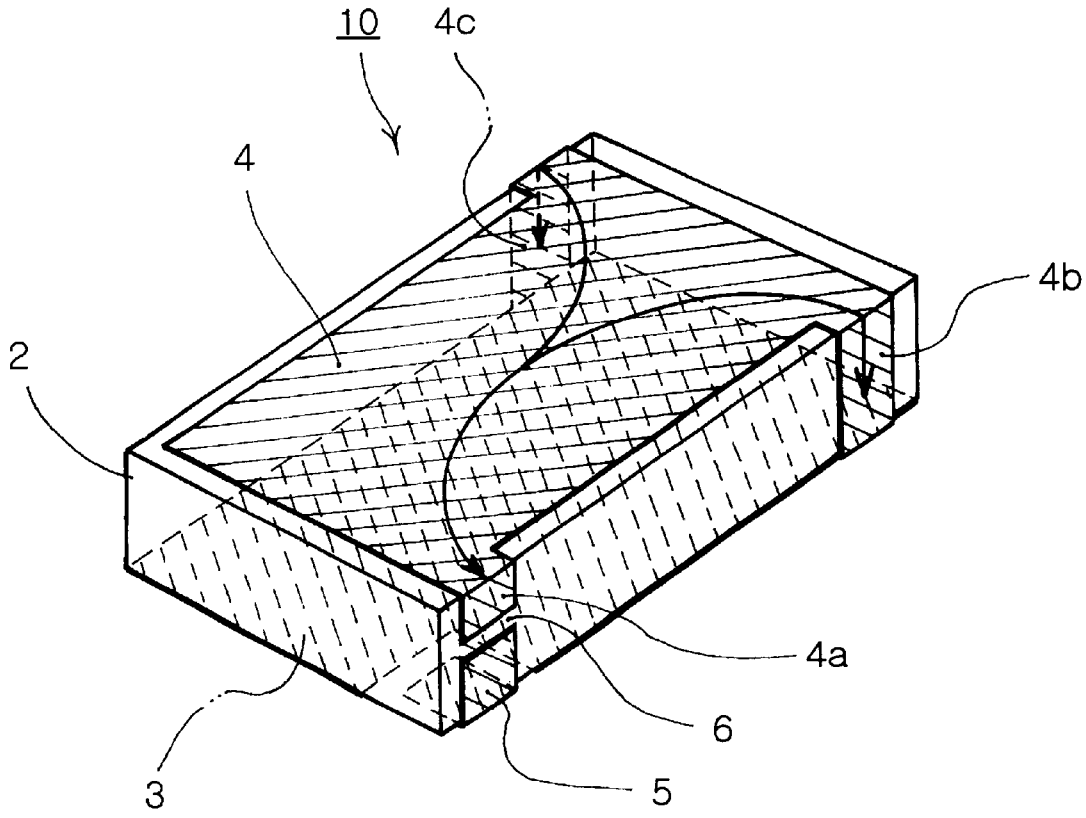
PRIOR ART FIG. 3
FIG. 3 is a perspective view of another conventional chip antenna.
Figure 4:
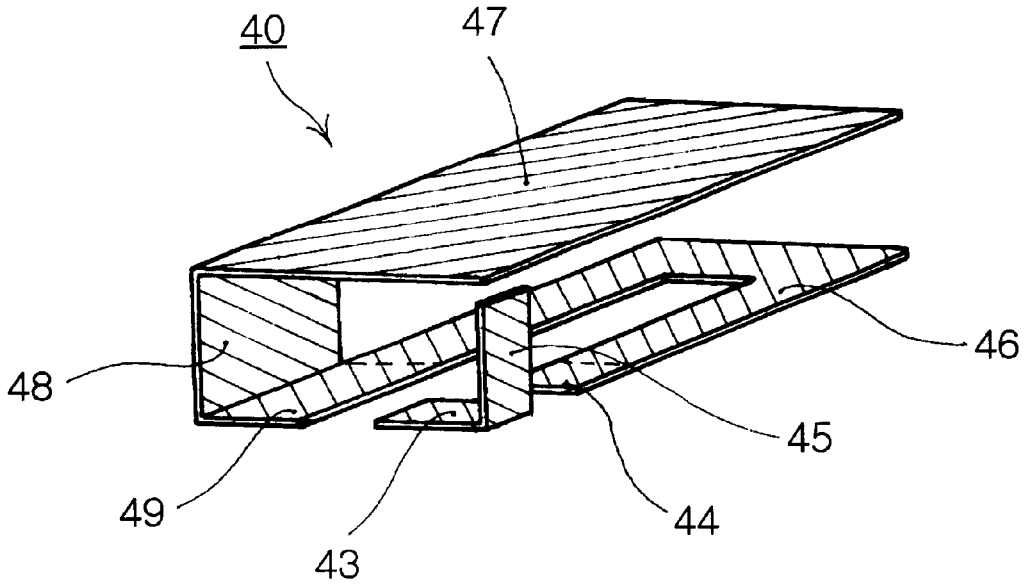
FIG. 4*a* is a perspective view of a multi band chip antenna in accordance with a first preferred embodiment of the present invention.
FIG. 4*b* is a bottom view of the multi band chip antenna in accordance with the first preferred embodiment of the present invention.
Figure 4:
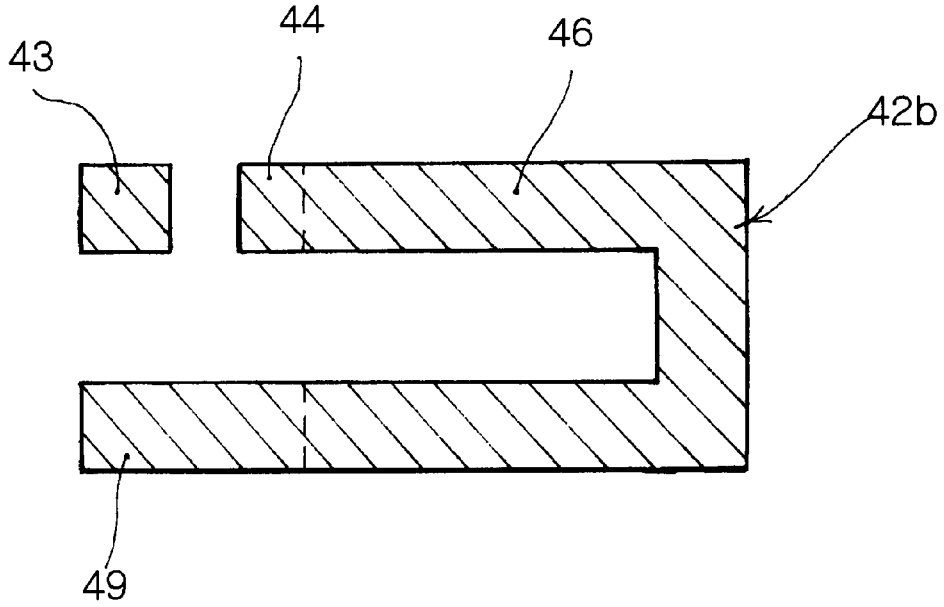

FIGS. 4*a* and 4*b* are a perspective view and a bottom view of a multi band chip antenna in accordance with a first preferred embodiment of the present invention, respectively. Hereinafter, with reference to FIGS. 4*a* and 4*b*, the multi band chip antenna of the first preferred embodiment of the present invention is described.

As shown in FIGS. 4*a* and 4*b*, the multi band chip antenna 40 of the first preferred embodiment of the present invention comprises a first conductive feeding port 43, a second conductive feeding port 44, a conductive power-feeding electrode 45 connected to the first feeding port 43, a conductive loop-type electrode 46 connected to the second feeding port 44, a conductive radiation electrode 47 electrically connected to the power-feeding electrode 45, a conductive ground electrode 48 connected to the radiation electrode 47, and a ground electrode port 49 connected to the ground electrode 48 and the loop-type electrode 46.

The second feeding port 44 is formed close to the first feeding port 43, thereby performing the electromagnetic coupling between the first feeding port 43 and the second feeding port 44. The first feeding port 43 is formed close to the ground electrode port 49.

The second feeding port 44 is connected to one end of the loop-type electrode 46. The ground electrode port 49 is connected to the other end of the loop-type electrode 46. The loop-type electrode 46 is formed in a loop shape with a predetermined length from one end connected to the second feeding port 44 to the other end connected to the ground electrode port 49.

The power-feeding electrode 45 is formed close to the radiation electrode 47, thereby performing the electromagnetic coupling between the power-feeding electrode 45 and the radiation electrode 47. The power-feeding electrode 45 is spaced from the radiation electrode 47 by a designated distance, thereby feeding power by the coupling of electrostatic capacitance. However, the power-feeding electrode 45 may be directly connected to the radiation electrode 47. Further, one end of the ground electrode 48 is connected to the radiation electrode 47, thereby generating a short between the radiation electrode 47 and ground electrode 48.

The aforementioned multi band chip antenna 40 of the present invention generates multiple resonances by the inductances of the electrodes determined by the lengths and the widths of the electrodes, and by a plurality of the electromagnetic couplings between the electrodes, thereby being usable at multiple bands.

The multi band chip antenna 40 of the first embodiment of the present invention is used at PSC band and GPS band. Further, the multi band chip antenna 40, which is usable at these multi bands, can split frequency into PSC band and GPS band through the dual feeding ports.

Figure 5:
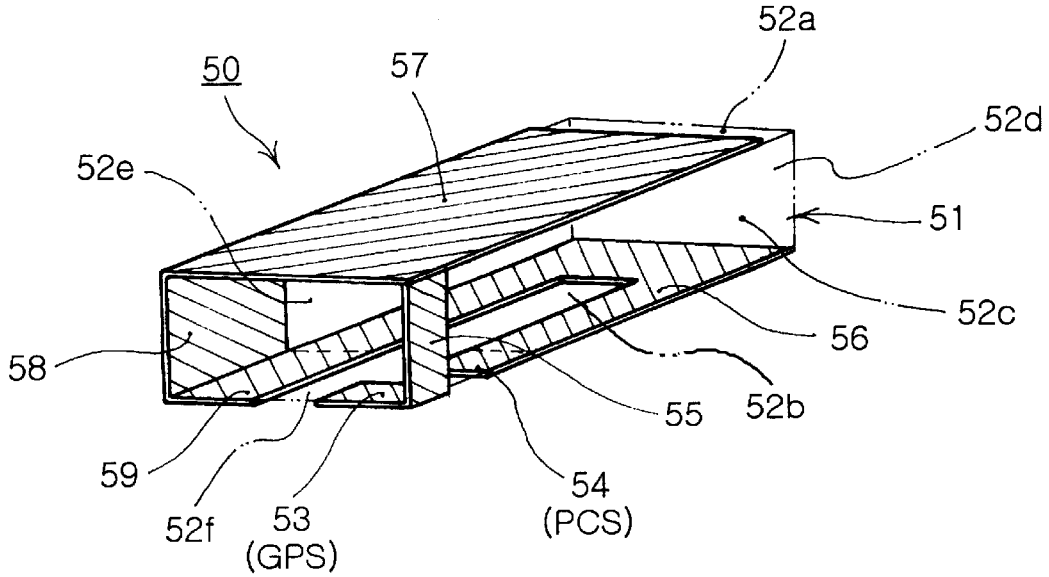
FIG. 5*a* is a perspective view of a multi band chip antenna in accordance with a second preferred embodiment of the present invention.
FIG. 5*b* is a bottom view of the multi band chip antenna in accordance with the second preferred embodiment of the present invention.
Figure 5:
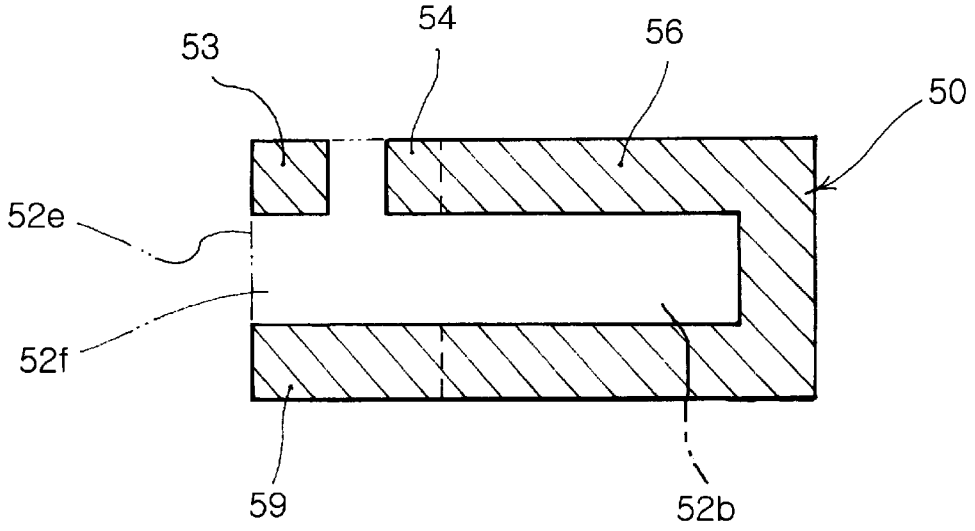

FIGS. 5*a* and 5*b* are a perspective view and a bottom view of a multi band chip antenna in accordance with a second preferred embodiment of the present invention, respectively. Hereinafter, with reference to FIGS. 5*a* and 5*b*, the multi band chip antenna of the second preferred embodiment of the present invention is described.

As shown in FIGS. 5*a* and 5*b*, the multi band chip antenna 50 of the second preferred embodiment of the present invention comprises a body 51 including the upper surface 52*a*, the lower surface 52*b*, and four side surfaces 52*c*, 52*d*, 52*e*, and 52*f*, a first conductive feeding port 53 formed on the lower surface 52*b* of the body 51, a second conductive feeding port 54 formed on the lower surface 52*b* of the body 51, a conductive power-feeding electrode 55 formed on one side surface 52*c* of the body 51 and connected to the first feeding port 53, a conductive loop-type electrode 56 formed on the lower surface 52*b* of the body 51, a conductive radiation electrode 57 formed on the upper surface 52*a* of the body 51 and electrically connected to the power-feeding electrode 55, a conductive ground electrode 58 formed on another side surface 52*e* of the body 51 and connected to the radiation electrode 57, and a ground electrode port 59 formed on the lower surface 52*b* of the body 51 and connected to the ground electrode 58 and the loop-type electrode 56.

The body 51 is made of dielectric material or magnetic material. As shown in FIG. 5*a*, the shape of the body 51 is a hexahedron having an upper surface 52*a*, a lower surface 52*b*, and four side surfaces 52*c*, 52*d*, 52*e*, and 52*f*. However, the shape of the body 51 is not limited thereto.

The second feeding port 54 is formed close to the first feeding port 53, thereby performing the electromagnetic coupling between the first feeding port 53 and the second feeding port 54. Further, the first feeding port 53 is formed close to the ground electrode port 59, thereby performing the electromagnetic coupling between the first feeding port 53 and the ground electrode port 59.

The second feeding port 54 is connected to one end of the loop-type electrode 56. The ground electrode port 59 is connected to the other end of the loop-type electrode 56. The loop-type electrode 56 is formed in a loop shape with a predetermined length from one end connected to the second feeding port 54 to the other end connected to the ground electrode port 59. The loop-type electrode 56 is spaced from the radiation electrode 57 by a designated distance, thereby performing the coupling of the electrostatic capacitance between the loop-type electrode 56 and the radiation electrode 57.

The power-feeding electrode 55 is formed close to the radiation electrode 57, thereby performing the electromagnetic coupling between the power-feeding electrode 55 and the radiation electrode 57.

The aforementioned multi band chip antenna 50 of the present invention generates multiple resonances by the inductances of the electrodes determined by the lengths and the widths of the electrodes, and by a plurality of the electromagnetic couplings between the electrodes, thereby being usable at multiple bands.

The same as the multi band chip antenna 40 of the first embodiment of the present invention, the multi band chip antenna 50 of the second embodiment of the present invention is usable at PSC band and GPS band. Further, the multi band chip antenna 50, which is usable at these multi bands, can split frequency into PSC band and GPS band through the dual feeding ports.

Figure 6:
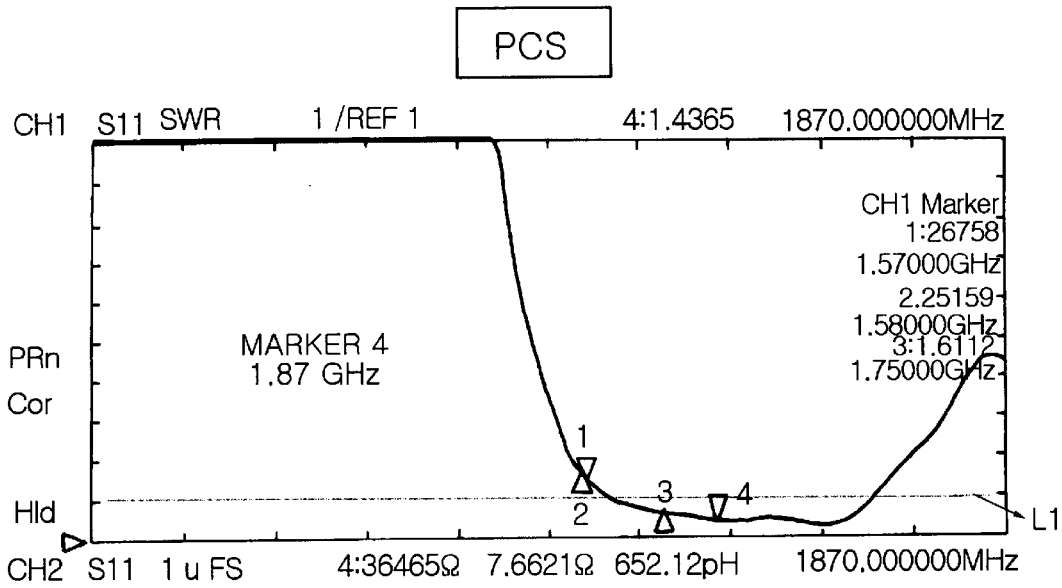
FIG. 6*a* is a VSWR (Voltage Standing Wave Ratio) graph at PCS band.
FIG. 6*b* is a VSWR (Voltage Standing Wave Ratio) graph at GPS band.
Figure 6:
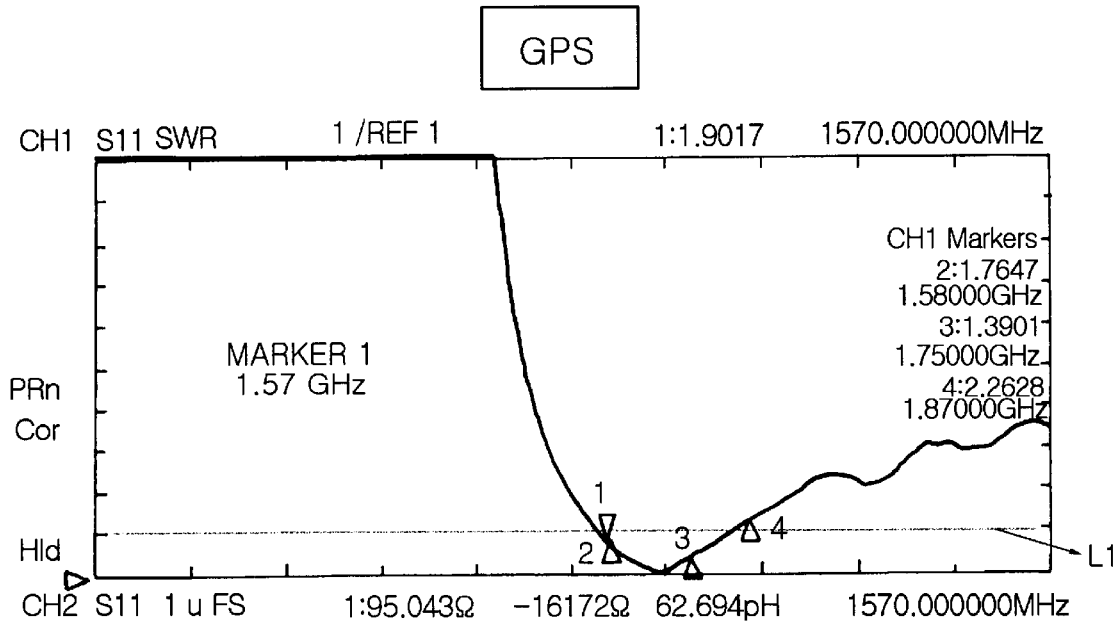

FIGS. 6*a* and 6*b* are VSWR (Voltage Standing Wave Ratio) graphs of the multi band chip antenna 40 of FIGS. 4*a* and 4*b*. FIG. 6*a* is a VSWR graph in PCS band, and FIG. 6*b* is a VSWR graph in GPS band.

In a line L1 of the graph, in which the ratio of the transmitting signal and the receiving signal is 2:1, a gain on a point 4(MARKER 4) corresponding to PCS band (1,870 MHz) and a point 1(MARKER 1) corresponding to GPS band (1,575 GHz) are high.

As shown in FIGS. 6*a* and 6*b*, the multi band chip antenna of the present invention can be usable at PCS band as well as GPS band.

As described above, the multi band chip antenna of the preferred embodiments of the present invention obtains high gain at PCS band and GPS band. Since the multi band chip antenna of the preferred embodiments of the present invention splits the frequency into PCS band and GPS band through the dual feeding ports, the mobile communication apparatus using the multi band chip antenna of the present invention does not require a band splitting unit such as the diplexer for splitting the frequency. Therefore, the multi band chip antenna of the present invention and the mobile communication apparatus using the multi band chip antenna can be further miniaturized.

Hereinafter, the mobile communication apparatus using the multi band chip antenna of the present invention is described in detail.

Figure 7:
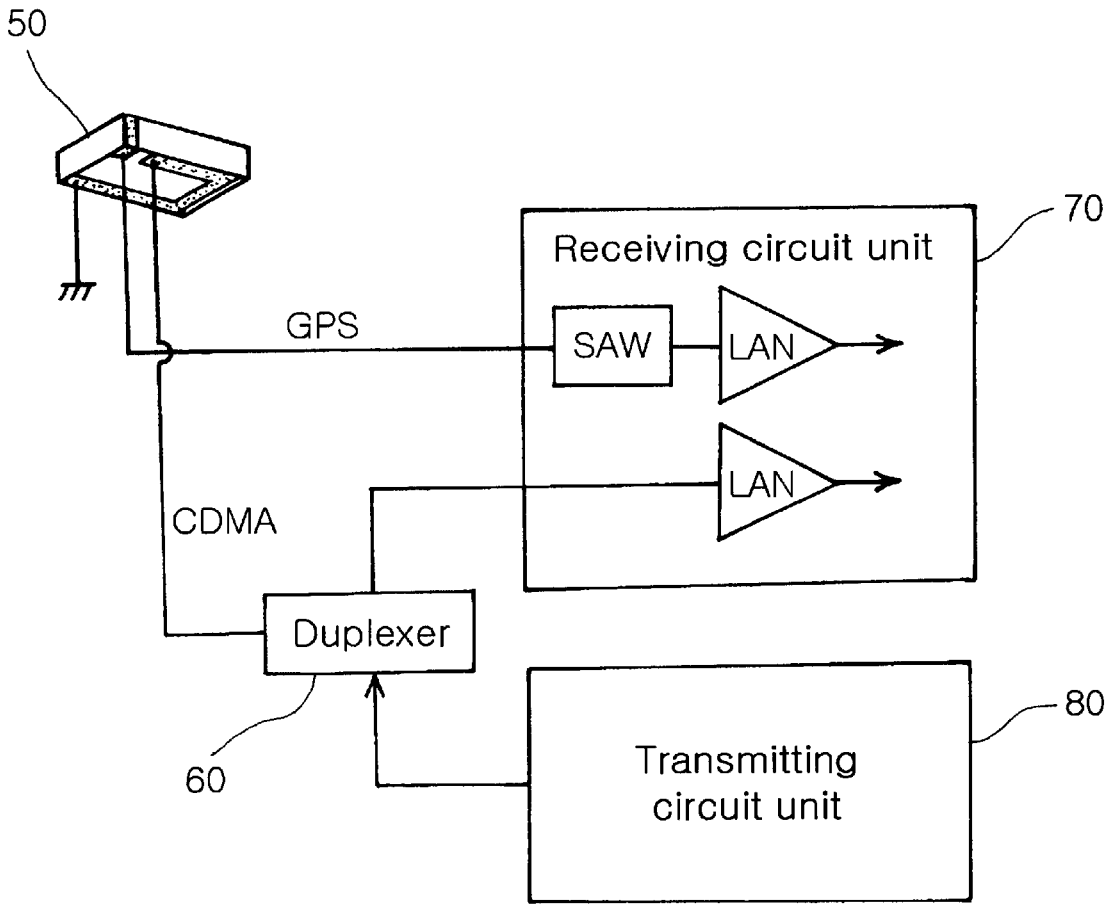
FIG. 7 is a schematic view showing a configuration of a mobile communication apparatus using the chip antenna of the present invention.

FIG. 7 is a schematic view showing a configuration of the mobile communication apparatus using the chip antenna of the present invention. As shown in FIG. 7, the multi band chip antenna 50 of the mobile communication apparatus comprises the first feeding port for performing the electromagnetic coupling, the second feeding port for performing the electromagnetic coupling, the power-feeding electrode connected to the first feeding port, the loop-type electrode connected to the second feeding port, the radiation electrode connected to the power-feeding electrode, the ground electrode connected to the radiation electrode, and the ground electrode port connected to the ground electrode and the loop-type electrode.

The multi band chip antenna 50 of the present invention may be mounted on a substrate of the mobile communication apparatus. At this time, the first feeding port, the second feeding port, and the ground electrode port of the multi band chip antenna 50 of the present invention are connected to the corresponding one of plural ports formed on the substrate.

The mobile communication apparatus using the multi band chip antenna 50 of the present invention comprises a duplexer 60, a receiving circuit unit 70, and the transmitting circuit unit 80. An antenna terminal of the duplexer 60 is connected to the first feeding port of the multi band chip antenna 50. The receiving circuit unit 70 is connected to the second feeding port of the multi band chip antenna 50, thereby processing a first receiving signal from the second feeding port. Then, the receiving circuit unit 70 is connected to a receiving terminal of the duplexer 60, thereby processing a second receiving signal from the receiving terminal. The transmitting circuit unit 80 is connected to a transmitting terminal of the duplexer 60, thereby processing a transmitting signal from the transmitting terminal and providing the processed signal.

As shown in FIG. 7, in case the mobile communication apparatus employs the multi band chip antenna of the present invention, since the multi band chip antenna of the present invention splits the frequency into GPS band and PCS band through the dual feeding ports, the mobile communication apparatus does not require a band splitting unit, for example, the diplexer or the switch.

As described above, the multi band chip antenna of the present invention comprises two feeding ports, each processing PCS band and GPS band, thereby being connected to a RF circuit unit without any diplexer. Since GPS band and PCS band are close to each other, the frequency division is very difficult, and if achieved, there is much loss. The multi band chip antenna of the present invention has been made in view of the above problems, and is usable at two different frequency bands.

The mobile communication apparatus employing the multi band chip antenna of the present invention may comprise a portable telephone, a PDA (Personal Digital Assistant) and the like. Further, the present invention may be applied not only to the chip antenna but also to the planar inverted F-type antenna (PIFA).

As apparent from the above description, in accordance with the present invention, the multi band chip antenna comprises the dual feeding ports formed on the radiation electrode structure and performs the electromagnetic coupling between the dual feeding ports, thereby being usable in multiple frequency bands. Therefore, the multi band chip antenna of the present invention reduces loss in splitting the frequency band and is miniaturized in size. Further, the mobile communication apparatus using the multi band chip antenna of the present invention does not require any band splitting unit such as a diplexer.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A chip antenna comprising:

a first conductive feeding port;

a second conductive feeding port;

a conductive power-feeding electrode connected to the first feeding port;

a conductive loop-type electrode connected to the second feeding port;

a conductive radiation electrode electrically connected to the power-feeding electrode;

a conductive ground electrode connected to the radiation electrode; and a conductive ground electrode port connected to the ground electrode and the loop-type electrode.

2. The chip antenna as set forth in claim 1, wherein the first feeding port performs the electromagnetic coupling with the second feeding port.

3. The chip antenna as set forth in claim 2, wherein the second feeding port is connected to one end of the loop-type electrode.

4. The chip antenna as set forth in claim 1, wherein the second feeding port is connected to one end of the loop-type electrode, thereby performing the electromagnetic coupling with the first feeding port.

5. The chip antenna as set forth in claim 1, wherein the ground electrode port is connected to the other end of the loop-type electrode.

6. The chip antenna as set forth in claim 5, wherein the loop-type electrode is formed in a loop shape with a designated length from one end connected to the second feeding port to the other end connected to the ground electrode port.

7. The chip antenna as set forth in claim 1, wherein the power-feeding electrode is spaced apart from the radiation electrode with a predetermined distance and performs the electromagnetic coupling with the radiation electrode.

8. The chip antenna as set forth in claim 1, wherein the power-feeding electrode directly connected the radiation electrode.

9. The chip antenna as set forth in claim 1, wherein the first feeding port is formed close to the second feeding port.

10. The chip antenna as set forth in claim 9, wherein the second feeding port is connected to one end of the loop-type electrode so as to be close to the first feeding port.

11. The chip antenna as set forth in claim 1, wherein the first feeding port is formed close to the ground electrode port.

12. A chip antenna comprising:

a body including an upper surface, a lower surface, and four side surfaces;

a first conductive feeding port formed on the lower surface of the body;

a second conductive feeding port formed on the lower surface of the body;

a conductive power-feeding electrode formed on one side surface of the body and connected to the first feeding port;

a conductive loop-type electrode formed on the lower surface of the body;

a conductive radiation electrode formed on the upper surface of the body and electrically connected to the power-feeding electrode;

a conductive ground electrode connected to another side surface of the body and connected to the radiation electrode; and a conductive ground electrode port formed on the lower surface of the body and connected to the ground electrode and the loop-type electrode.

13. The chip antenna as set forth in claim 12, wherein the first feeding port performs the electromagnetic coupling with the second feeding port.

14. The chip antenna as set forth in claim 13, wherein the second feeding port is connected to one end of the loop-type electrode.

15. The chip antenna as set forth in claim 12, wherein the second feeding port is connected to one end of the loop-type electrode, thereby performing the electromagnetic coupling with the first feeding port.

16. The chip antenna as set forth in claim 12, wherein the ground electrode port is connected to the other end of the loop-type electrode.

17. The chip antenna as set forth in claim 16, wherein the loop-type electrode is formed in a loop shape with a designated length from one end connected to the second feeding port to the other end connected to the ground electrode port.

18. The chip antenna as set forth in claim 12, wherein the power-feeding electrode is spaced apart from the radiation electrode with a predetermined distance and performs the electromagnetic coupling with the radiation electrode.

19. The chip antenna as set forth in claim 12, wherein the power-feeding electrode directly connected the radiation-electrode.

20. The chip antenna as set forth in claim 12, wherein the first feeding port is formed close to the second feeding port.

21. The chip antenna as set forth in claim 20, wherein the second feeding port is connected to one end of the loop-type electrode so as to be close to the first feeding port.

22. The chip antenna as set forth in claim 12, wherein the first feeding port is formed close to the round electrode port.

23. The chip antenna as set forth in claim 12, wherein the body is made of one selected from the group consisting of magnetic material and dielectric material.

24. A mobile communication apparatus using a chip antenna, said mobile communication apparatus comprising:

a chip antenna comprising:

a first conductive feeding port for performing the electromagnetic coupling;

a second conductive feeding port for performing the electromagnetic coupling;

a power-feeding electrode connected to the first feeding port;

a loop-type electrode connected to the second feeding port;

a radiation electrode electrically connected to the power-feeding electrode;

a ground electrode connected to the radiation electrode; and a ground electrode port connected to the ground electrode and the loop-type electrode;

a duplexer, of which antenna terminal is connected to the first feeding port of the chip antenna;

a receiving circuit unit, which is connected to the second feeding port of the chip antenna, thereby processing a first receiving signal from the second feeding port, and is then connected to a receiving terminal of the duplexer, thereby processing a second receiving signal from the receiving terminal; and a transmitting circuit unit, which is connected to a transmitting terminal of the duplexer, thereby processing a transmitting signal from the transmitting terminal and providing the processed signal.

* * * * *